US005266039A

United States Patent [19]

Boyer et al.

[11] Patent Number: 5,266,039

[45] Date of Patent: Nov. 30, 1993

[54] ELECTRICAL OUTLET RECEPTACLE

[75] Inventors: Scott A. Boyer, North Providence; Ralph L. Graves, East Greenwich, both of R.I.

[73] Assignee: General Electric Company, Schenectady, N.Y.

[21] Appl. No.: 976,063

[22] Filed: Nov. 13, 1992

[51] Int. Cl.[5] ..... H01R 25/00

[52] U.S. Cl. ..... 439/107; 439/650

[58] Field of Search ..... 439/106, 107, 650

[56] References Cited

U.S. PATENT DOCUMENTS

| | | | |
|---|---|---|---|
| 3,126,239 | 3/1964 | Winter et al. | 439/107 |
| 3,718,894 | 2/1973 | Schumacher | 439/689 |
| 3,812,445 | 5/1974 | Stefani | 439/650 |
| 4,172,628 | 10/1979 | Lingaraju | 439/650 |
| 4,203,638 | 5/1980 | Tansi | 439/97 |
| 4,375,307 | 3/1983 | Rock | 439/107 |
| 4,836,793 | 6/1989 | Munroe | 439/107 |
| 4,854,885 | 8/1989 | Bowden, Jr. et al. | 439/107 |

FOREIGN PATENT DOCUMENTS

| | | | |
|---|---|---|---|
| 2217928 | 11/1989 | United Kingdom | 439/650 |

*Primary Examiner*—Gary F. Paumen

*Attorney, Agent, or Firm*—Edward M. Corcoran; Stanley C. Corwin

[57] ABSTRACT

An electrical outlet receptacle includes a thermoplastic cover and a thermoset base between which are captively mounted line and neutral contact/terminal assemblies and a grounding strap assembly in enhanced electrically isolated relation. The grounding strap assembly is equipped with quadruple wipe grounding contacts positioned to make wiping contact with a ground pin of an inserted plug before the plug blades can contact jaws of the contact/terminal assemblies. Formations molded in the cover underside provide guidance for and promote alignment of the insertions of the plug blades and pin. Tapered pockets molded in the cover underside are positioned to controllably engage the ends of BWPI terminated line and neutral wires.

11 Claims, 4 Drawing Sheets

ELECTRICAL OUTLET RECEPTACLE

The present invention relates to wiring devices and particularly to a duplex electrical outlet receptacle having improved structural durability, higher dielectric breakdown characteristics, and enhanced contact integrity.

BACKGROUND OF THE INVENTION

The mass produced electrical outlet receptacle installed throughout homes and commercial buildings must be designed to meet Underwriters Laboratory (UL) standards. A new set of standards known as UL 498, which becomes effective in 1995, will impose even stricter design requirements on manufacturers. Receptacles are indeed rather simple electrical wiring devices, yet their design must be such as to withstand voltage surges of several thousand volts. They include internal line, neutral and ground circuit elements that must maintain a high degree of integrity over a long service life. In numerous installations, the receptacle must endure repeated plug insertions and withdrawals which are frequently executed in a haphazard manner. The internal contacts must be capable of accepting this abusive treatment without significant degradation of their low ohmic contact engagement with the line and neutral blades and ground pin of the plug. Moreover, the insulative plastic receptacle case must be sufficiently robust so as not to fracture when subjected to plug insertions and withdrawals that are not substantially normal to the receptacle face. The case must also provide requisite clearances between internal circuit elements to meet dielectric breakdown voltage requirements and have sufficient temperature stability to withstand "hot spots".

Continued integrity of the receptacle ground circuit elements is an important safety factor. If the ground circuit through the receptacle loses its normal low impedance characteristics, human shock potential due to the existence of a ground fault in a plug-connected load increases dramatically.

In addition to the above considerations, the receptacle must be designed to accommodate safe and convenient circuit installation by homeowners who are not electricians and have little experience and background in electrical matters. To this end, electrical receptacles are typically equipped with both binding head screw terminals and back-wire push-in (BWPI) terminals where the bared ends of solid wire line and neutral conductors are inserted through back openings in the receptacle case and into electrical contacting engagement with resilient prongs. Since BWPI terminations do not grip the conductor wire as securely as binding head screw terminations, they can be disturbed as the wired receptacle is mounted in a outlet box.

SUMMARY OF THE INVENTION

To address the foregoing considerations, the present invention provides an improved electrical outlet receptacle having a plastic case comprised of a thermoplastic cover and a thermoset base and containing a grounding strap and line and neutral contact/terminal assemblies. Interior formations molded into the base and cover serve to mount the grounding strap assembly in requisite oversurface clearance relation with the line and neutral contact/terminal assemblies to achieve enhanced dielectric breakdown voltage characteristics.

The grounding strap assembly is equipped with at least one multiple wipe grounding contact for engaging the ground pin of an inserted plug connector. The grounding contact, in addition to achieving consistent low ohmic engagement with the ground pin, cooperates with internal ribs molded into the cover in guiding ground pin insertion and withdrawal. Internal skirts also molded into the cover about the blade slots serve to guide insertions and withdrawals of the line and neutral blades of a plug. As an additional safety feature, the grounding contact is positioned at a shallower depth than the line and neutral contacts to ensure that the ground circuit for a plug-connected load is completed before the line and neutral side circuits are completed. Tapered pockets molded in the underside of the cover grip the stripped ends of line and neutral solid wire conductors beyond the prong contacts of BWPI terminations to minimize wire disturbance during receptacle mounting in an outlet box.

The invention accordingly comprises features of construction, combinations of elements and arrangements of parts, all as detailed hereinafter, and the scope of the invention will be indicated in the claims.

BRIEF DESCRIPTION OF THE DRAWINGS

For a full understanding of the nature and objectives of the present invention, reference may be had to the following Detailed Description taken in conjunction with the accompanying drawings, in which.

Corresponding reference numerals refer to like parts throughout the several views of the drawings.

DETAILED DESCRIPTION

Figure 1:
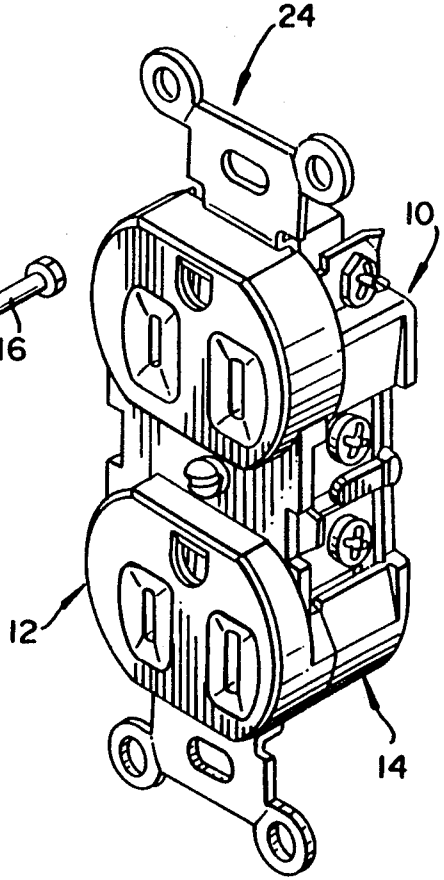
FIG. 1 is a perspective view of an electrical outlet receptacle constructed in accordance with the present invention.
Figure 2:
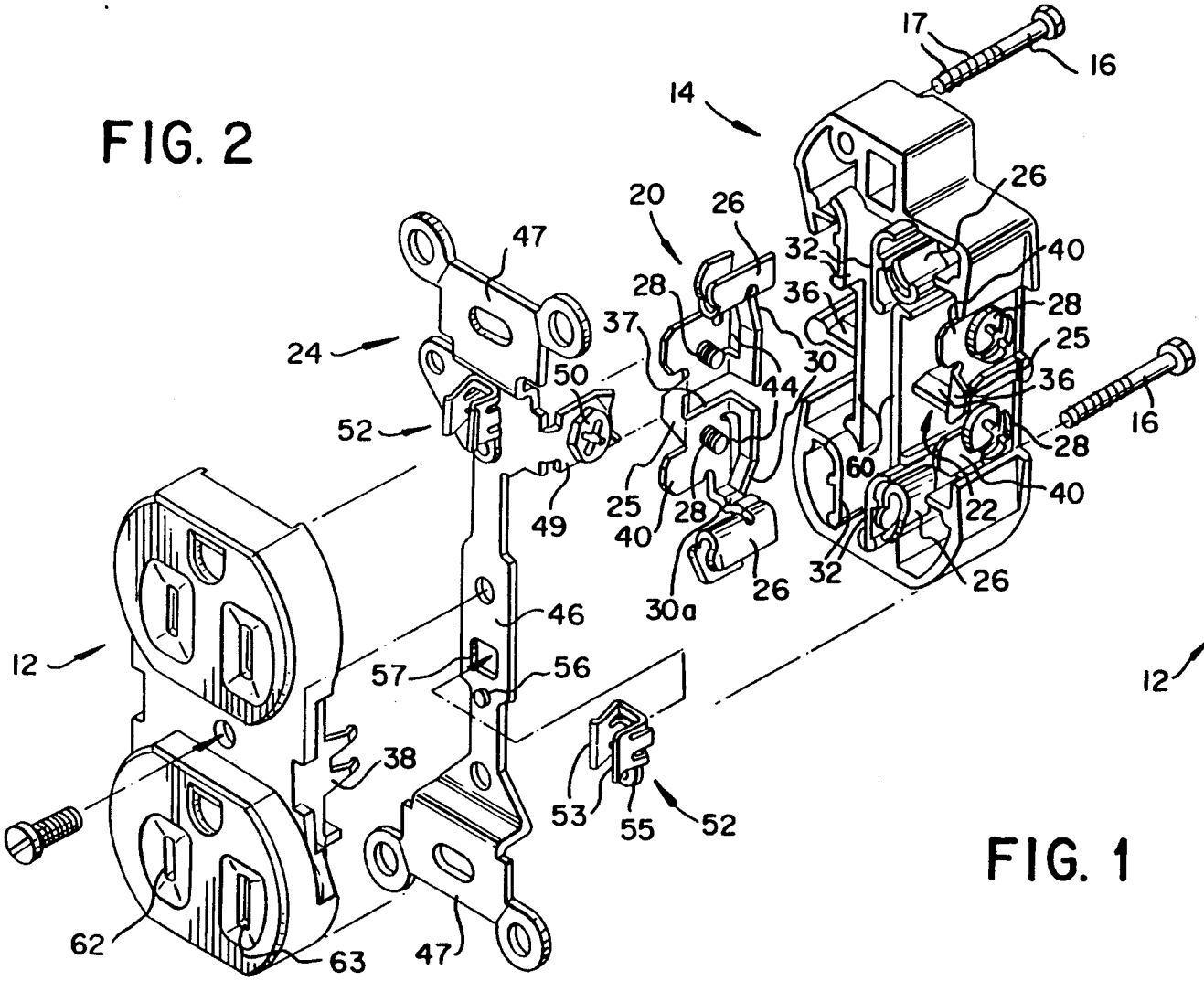
FIG. 2 is an exploded assembly view of the electrical outlet receptacle of FIG. 1.

The duplex electrical outlet receptacle 10 of the present invention, as seen in FIG. 1 includes a cover, generally indicated at 12, and a base, generally indicated at 14, which are secured in mated relation by a pair of drive screws 16 (FIG. 2). The shanks of these screws are provided with a series of annular fetters 17 which engage the sidewalls of wells 18 molded in the underside of the cover (FIG. 3) when the screws are driven home. The cover is formed of a thermoplastic plastic, whereas the base is formed of a thermoset plastic. Utilization of a thermoplastic cover inherently provides improved durability and strength, and thus is less prone to breakage, particularly where thin molded projections are concerned. The base is formed of a thermoset plastic to provide inherent high temperature stability and thus more resistance to hot spots that would soften or melt a thermoplastic base.

Figure 4:
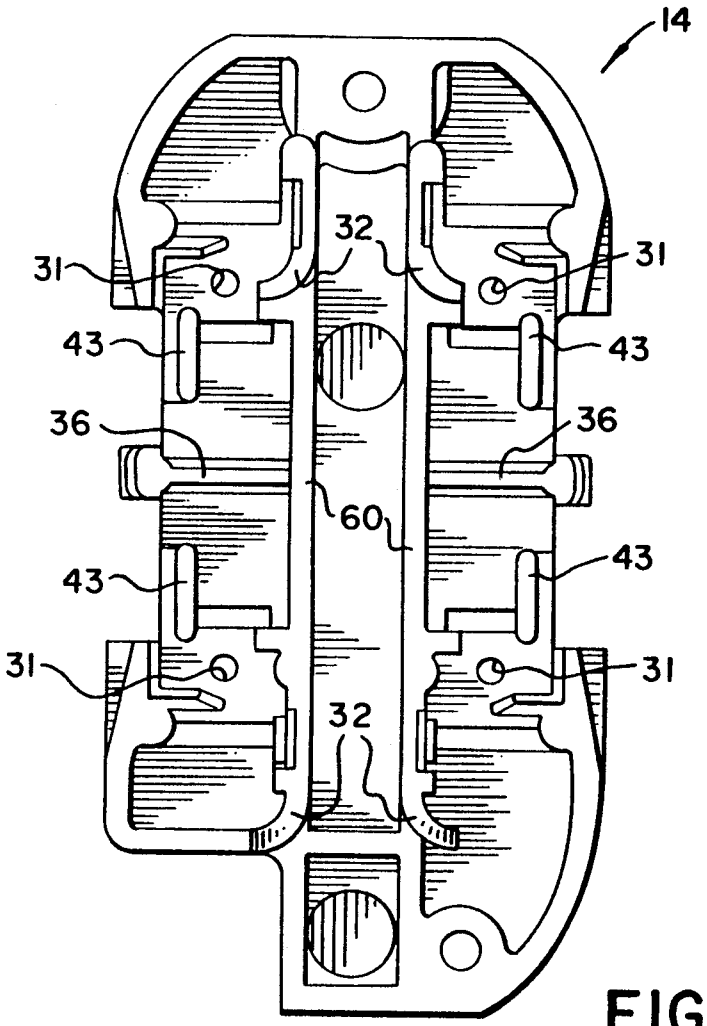
FIG. 4 is a plan view of the base part of the receptacle case seen in FIGS. 1 and 2.

Held captive between the mated base and cover are a line side contact/terminal assembly, generally indicated at 20, and a neutral side contact/terminal assembly, generally indicated at 22, which are located in flanking relation to a steel grounding strap assembly, generally indicated at 24, all as seen in FIG. 2. Each conventional contact/terminal assembly includes a pair of contact-/terminal sets interconnected by a breakaway tab 25, with each set comprising a jaw contact 26 for gripping an inserted plug blade (not shown), a binding head screw terminal 28, and a resilient prong 30 as a BWPI terminal for gripping the bared termination of a solid wire conductor inserted through a hole 31 in base 14 (FIG. 4). The contact terminal assemblies are located and held in place between the cover and base by interior formations molded therein. Of particular note are separate upstanding barriers 32 molded in the base in juxtaposition with each contact jaw 26 to electrically isolate these contact elements from grounding strap assembly 24. These barriers are of a height in excess of the contact height and lap with a pair of interior longitudinal ribs 34 (FIGS. 2 and 3) molded in cover 12 to dramatically increase the dielectric breakdown voltage between the grounding strap and the contact jaws. Also serving to positionally locate the contact terminal assemblies are transverse, upstanding ribs 36 (FIGS. 2 and 4) molded in base 14, which are received in gaps 37 between the contact/terminal sets beneath breakaway tab 25. These transverse ribs are straddled by bifurcated tabs 38 molded in cover 12 so as to also serve in guiding the cover into proper mated relation with the base during receptacle assembly. In addition, projections 40 (FIG. 2) of the contact/terminal assemblies are lodged in rectangular pockets 42 (FIG. 3) molded in the underside of the cover and ribs 43 (FIG. 4) in the base backing the assembly edges 44 (FIG. 2) opposite the projections 40 to maintain the assembly position while the binding head screws are tightened during installation.

Grounding strap assembly 24 includes, as seen in FIG. 2, an elongated steel strap 46 terminated at each end by offset mounting ears 47 which accept screws used to install the receptacle in an outlet box (not shown). A terminal pad 49 bent away from strap 46 is tapped to receive a binding head screw 50 utilized to connect the receptacle into the ground circuit of an electrical power cable.

Figure 5:
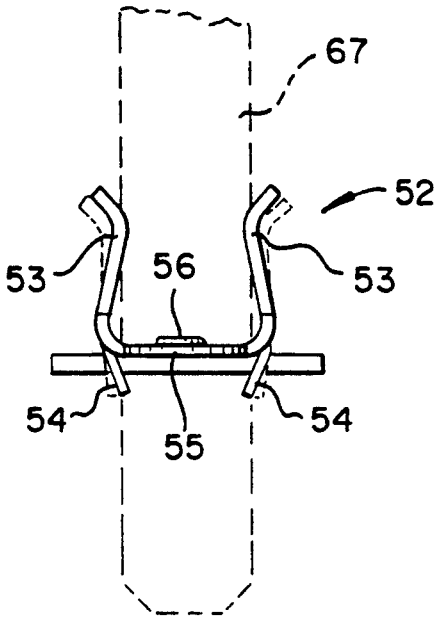
FIG. 5 is an end view of one of the grounding contacts seen in FIG. 2.

As a feature of the present invention, the grounding strap assembly is equipped with quadruple- wipe copper alloy contacts, generally indicated at 52. As best seen in FIGS. 2 and 5, each grounding contact is formed from a copper alloy sheet blank having a pair of upwardly bent, opposed, resilient contact arms 53, a pair of downwardly bent, opposed, resilient contact tabs 54, and a laterally extending mounting tab 55. This mounting tab is apertured to receive a raised post 56 punched in strap 46, which is then staked or headed to mechanically affix and electrically connect the grounding contact to the strap with the downwardly extending contact tabs projecting through a rectangular opening 57 in the strap.

In assembly, the grounding strap assembly is clamped between the outer edges of longitudinal ribs 34 in cover 12 and of longitudinal ribs 60 (FIG. 4) formed in base 14. The uniform transverse spacing between the cover ribs is widened in the regions beneath ground pin openings 61 to receive outstanding contact arms 53 of the grounding contacts. The heights of these mounting ribs are such that the grounding strap assembly is located with its grounding contacts positioned at a shallower depth behind ground pin openings 61 than are the positions of the line and neutral contact jaws behind line 62 and neutral 63 blade slots. Thus, when a plug is plugged into the receptacle, its grounding pin must engage grounding contact arms 53 before its blades can engage line and neutral contact jaws 26. The ground circuit through the receptacle is therefore established before the line and neutral side circuits are established. This safety feature affords human shock protection should the appliance connected to the plug have an existing ground fault.

Figure 3:
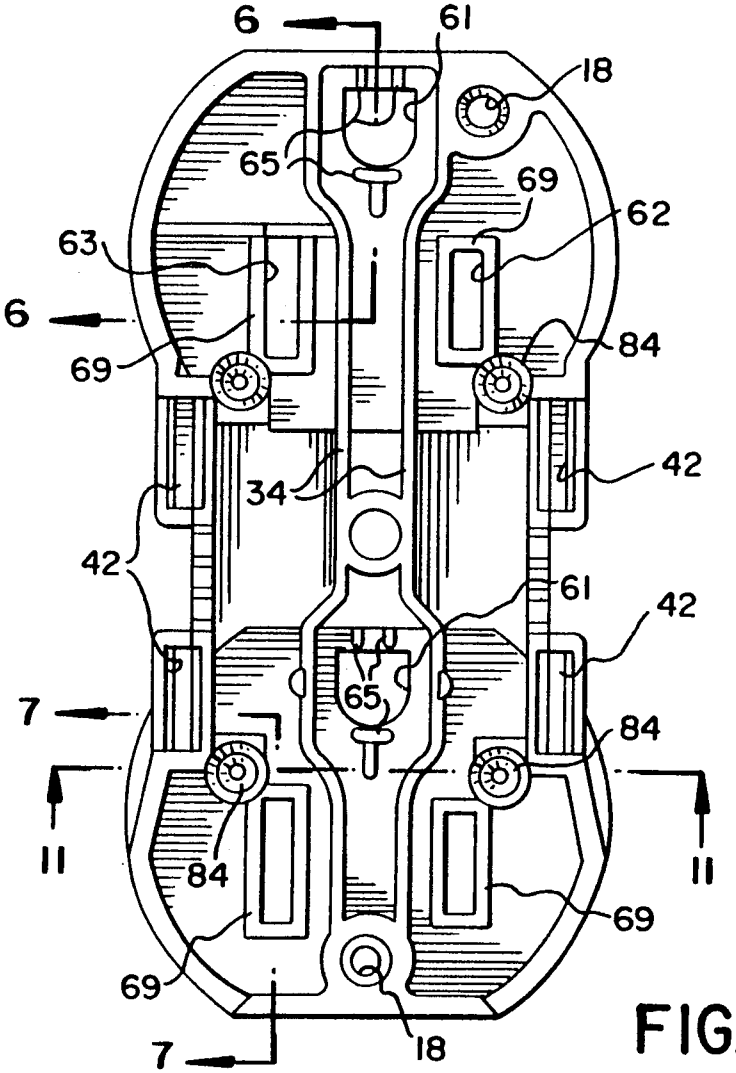
FIG. 3 is a plan view of the cover part of the receptacle case seen in FIGS. 1 and 2.
Figure 6:
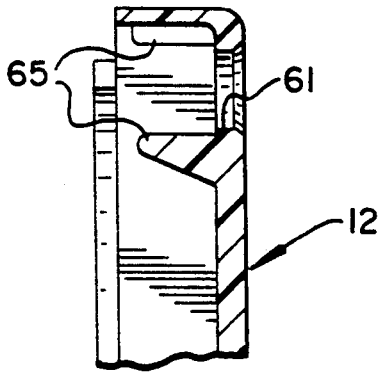
FIG. 6 is a sectional view taken along line 6—6 of FIG. 3.

As best seen in FIGS. 3 and 6, outstanding alignment ribs 65 are molded in the underside of the cover adjacent each ground pin opening 61. These ribs are positioned in opposed interrelation and in orthogonal relation to grounding contact arms 53. Thus the initial portion of the grounding pin passageway into the receptacle is bounded on four sides by the grounding contact arms and the alignment ribs 65. This positive insertion guidance forcibly corrects initial, skewed grounding pin insertions to the appropriate insertion orientation normal to the cover face. Then, when full insertion is achieved, the grounding pin is also engaged by contact tabs 54. It is thus seen that, upon initial insertion, a grounding pin 67 (FIG. 5) achieves double wipe electrical contact with contact arms 53 and, as insertion continues, double wipe contact with contact tabs 54. Improved grounding pin retention and low ohmic contact is thus achieved by the quadruple wipe grounding contacts 52. In addition, the contact tabs 54, backed by the rectangular openings in strap 46, serve to establish a properly centered grounding pin position in the receptacle.

Figure 7:
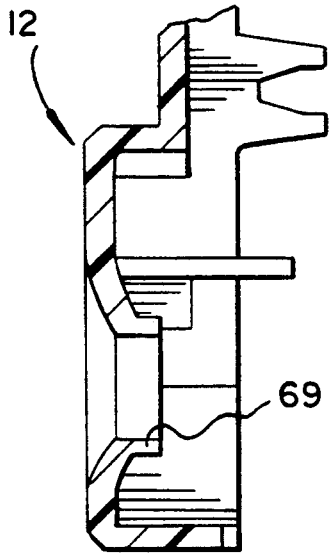
FIG. 7 is a sectional view taken along line 7—7 of FIG. 3.

Insertion alignment for the plug blades is provided by raised rectangular skirts 69 (FIGS. 3 and 7) molded in the underside of cover 12 in bounding relation with blade slots 62, 63. These skirts also reinforce these blade slots to resist cover damage caused by repeated, haphazard plug insertions.

Figure 10:
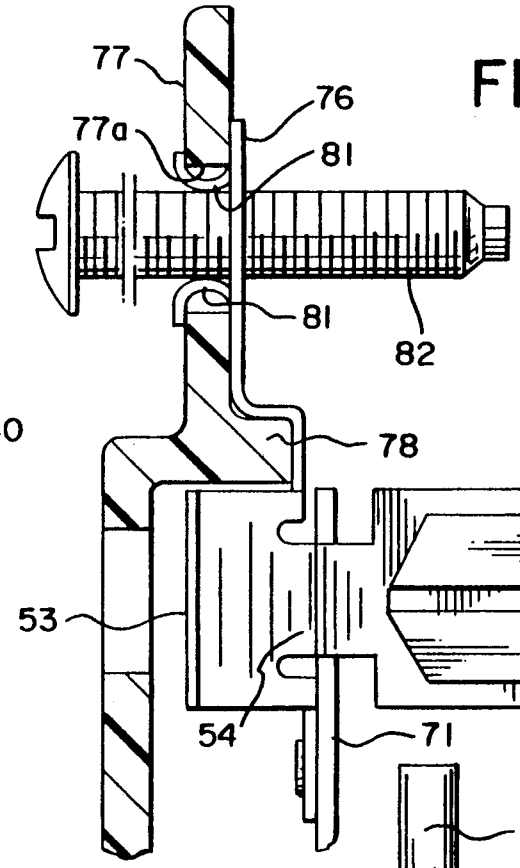
FIG. 10 is a fragmentary sectional view illustrating the assembly of the grounding strap of FIG. 8 and grounding contact of FIG. 9 in an electrical outlet receptacle.
Figure 9:
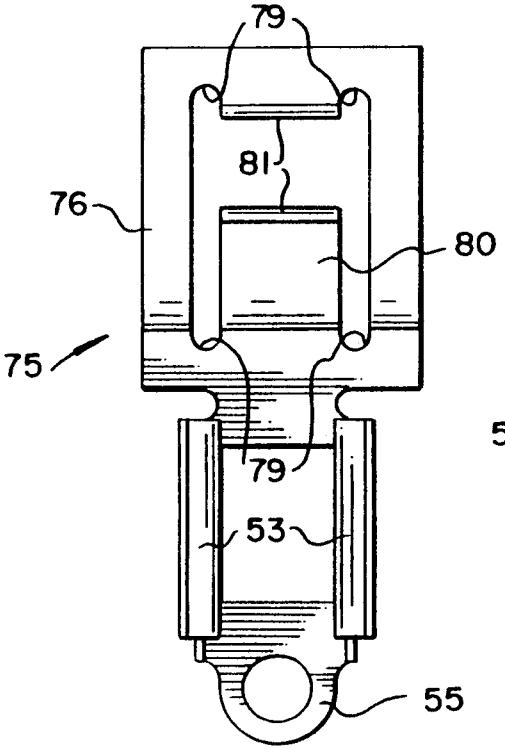
FIG. 9 is a plan view of a grounding contact utilized in the grounding strap of FIG. 8.
Figure 8:
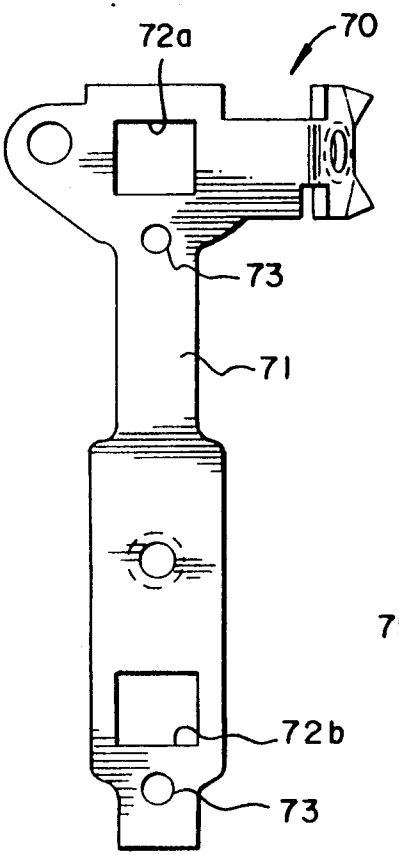
FIG. 8 is a plan view of an alternative grounding strap constructed in accordance with the present invention.

Some recent receptacle configurations have eliminated the mounting ears 47 at the ends of the grounding strap assembly and instead provided mounting ears as integral extensions of the cover. A grounding strap assembly 70 then takes the form illustrated in FIG. 8, sans the mounting ears. The assembly includes a grounding strap 71 includes rectangular openings **72*a* and 72*b* and posts 73 for mounting quadruple wipe copper alloy grounding contacts 52 in the manner described above for grounding strap assembly 24. However, to provide automatic grounding incident with outlet box installation, the grounding contact affixed in strap opening 72*a*, generally indicated at 75 in FIGS. 9 and 10, is additionally, integrally formed with a grounding pad 76. Thus grounding contact 75 includes upper contact arms 53, lower contact tabs 54 and apertured mounting tab 55, as in the case of grounding contact 52. Grounding pad 76 extends from the opposite end from mounting tab 55** in an offset plane so as to be adjacent to and closely follow the contour of a plastic mounting ear 77 integrally formed with a thermoplastic receptacle cover 78. The grounding pad is relieved at 79 to provide prongs 80 which are formed with upturned ends 81 for projection into mounting ear opening 77*a* and in electrical contacting engagement with outlet box mounting screw 82. Thus when the receptacle is installed in a metal outlet box, grounding strap assembly 70 is automatically grounded thereto by screw 82.

Figure 11:
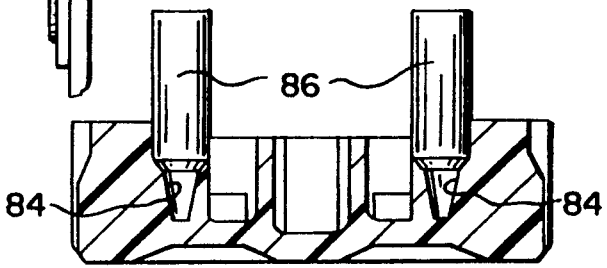
FIG. 11 is a sectional view taken along line 11—11 of FIG. 3.

As an additional feature of the present invention, cover 12 is formed with pockets 84 (FIGS. 3 and 11) in respective positions aligned with hole 31 (FIG. 4) provided in base 14 for back-wire push-in (BWPI) wiring installation. When the insulation-stripped end of a 14 AWG or 12 AWG copper wire is inserted through a base hole 31, it passes between the blunt end of a prong 30 and a bridging segment 30*a* of a contact/terminal assembly 20, 22 (FIG. 2) and bottoms out in the aligned one of the pockets 84. During insertion, the wire ends are directed into the pockets by molded guides 86 (FIG. 11) upstanding from the pocket open ends. The pocket sidewall is tapered such that the blunt end of either wire size is engaged in the pocket to prevent lateral movement. As a result, the end sections of wires protruding into the receptacle case are positionally stabilized by the case holes 31, the cover pockets 84 and the intermediate electrical engagement of prongs 30 clamping the wire sections against bridging segments 30*a*. Disturbance and possible degradation of these BWPI electrical terminations are minimized as the line and neutral wires are crammed into an outlet box during installation of the receptacle.

It is seen from the foregoing that the objectives set forth, including those made apparent from the Detailed Description, are efficiently attained, and, since certain changes may be made in the construction set forth without departing from the present invention, it is intended that matters of detail be taken as illustrative and not in a limiting sense.

What is claimed is:

1. An electrical outlet receptacle comprising, in combination:

A. a molded plastic cover having a plurality of face openings accommodating insertions of a pair of blades and a grounding pin of a plug connector;

B. a molded plastic base mated with said cover to provide a receptacle case;

C. a pair of contact/terminal assemblies captively mounted between said mated cover and base, said contact/terminal assemblies including contact jaws aligned behind said blade insertion face openings and binding head screw terminals accessible at sides of said case;

D. a grounding strap assembly captively mounted between said mated base and cover, said grounding strap assembly including 1) a grounding contact having a pair of opposed upstanding, resilient contact arms and a laterally extending mounting tab with an aperture therein, and 2) an elongated metallic strap having an opening therein and an integral, upstanding post projecting through said mounting tab aperture and having a deformed head portion to affix said grounding contact in electrical connection to said strap in a position aligning said contact arms and said strap opening behind said grounding pin insertion face opening; and E. means for electrically isolating said grounding strap assembly from said contact/terminal assemblies, said means including, 1) a first pair of elevated longitudinal ribs formed in said base 2) a second pair of longitudinal ribs formed in said cover such that, with said cover and base mated, said strap of said grounding strap assembly is clamped between confronting longitudinal edges of said first and second longitudinal rib pairs, and 3) barriers upstanding from said first longitudinal rib pair in positions to electrically isolate said contact jaws from said strap.

2. The electrical outlet receptacle defined in claim 1, wherein said first and second pairs of longitudinal ribs are of heights to position said grounding contact arms at a shallower depth behind said face openings than said contact jaws.

3. The electrical outlet receptacle defined in claim 1, wherein said grounding contact further includes a pair of opposed contact tabs depending into said strap opening, whereby a grounding pin penetrating said grounding pin insertion face opening achieves initial double wipe electrical contact engagement with said contact arms and subsequent double wipe electrical contact engagement with said contact tabs.

4. The electrical outlet receptacle defined in claim 3, wherein said grounding contact tabs are located in underlying relation with said grounding contact arms.

5. The electrical outlet receptacle defined in claim 3, which further includes alignment ribs formed in said cover in depending positions between said grounding contact arms to define a four-sided insertion passageway for a grounding pin.

6. The electrical outlet receptacle defined in claim 5, which further includes a raised, open rectangular skirt formed in said cover behind each of said blade insert face openings.

7. The electrical outlet receptacle defined in claim 6, wherein said cover is formed of a thermoplastic material and said base is formed of a thermoset material.

8. The electrical outlet receptacle defined in claim 3, wherein said grounding contact further includes a laterally extending grounding pad having an opening therein with opposed prongs projecting from said grounding pad opening to make electrical contacting engagement with an outlet box mounting screw.

9. The electrical outlet defined in claim 3, wherein said strap is formed of steel and said grounding contact is formed of a copper alloy.

10. The electrical outlet receptacle defined in claim 3, wherein said contact/terminal assemblies include prongs in positions to make clamping electrical contacting engagement with insulation-free wire end segments inserted through holes in said base, and wherein said cover further includes pockets formed therein in positions to receive fully inserted wire end segments, said pockets having tapered sidewalls to provide strain relieving lateral confinement for wire end segments of varying wire size.

11. The electrical receptacle defined in claim 10, wherein said cover further includes a guide element upstanding from each said pocket to direct an inserted wire end segment into said pocket.

* * * * *